US011952843B2

(12) United States Patent
Newton

(10) Patent No.: US 11,952,843 B2
(45) Date of Patent: Apr. 9, 2024

(54) WELL COLUMN PIPE HOLDING TOOL

(71) Applicant: Paul A. Newton, Belle Plaine, KS (US)

(72) Inventor: Paul A. Newton, Belle Plaine, KS (US)

( * ) Notice: Subject to any disclaimer, the term of this patent is extended or adjusted under 35 U.S.C. 154(b) by 0 days.

(21) Appl. No.: 17/887,419

(22) Filed: Aug. 13, 2022

(65) Prior Publication Data

US 2022/0389775 A1 Dec. 8, 2022

Related U.S. Application Data

(63) Continuation-in-part of application No. 17/494,572, filed on Oct. 5, 2021, now abandoned.

(51) Int. Cl.
*E21B 19/10* (2006.01)

(52) U.S. Cl.
CPC ..... *E21B 19/10* (2013.01)

(58) Field of Classification Search
CPC ..... E21B 19/10; E21B 19/07
See application file for complete search history.

(56) References Cited

U.S. PATENT DOCUMENTS 326,380 A * 9/1885 Ball ..... E21B 19/10 81/176.1
540,093 A * 5/1895 Fitzgerald ..... E21B 19/10 188/67
612,061 A * 10/1898 Shambaugh et al. ... E21B 19/10 188/67
1,058,577 A * 4/1913 Gardner ..... E21B 19/10 188/67
1,138,195 A * 5/1915 Cox ..... E21B 19/10 81/186
1,216,943 A * 2/1917 Champie ..... E21B 19/10 188/67
1,460,402 A * 7/1923 Benckenstein ..... E21B 19/10 188/67
1,543,266 A * 6/1925 Powell ..... E21B 19/10 188/67
2,527,954 A * 10/1950 Nixon ..... E21B 19/10 175/423
3,637,011 A * 1/1972 Wheeler ..... E21B 19/10 269/96
3,739,434 A * 6/1973 Wheeler ..... E21B 19/10 166/77.51
4,898,238 A * 2/1990 Grantom ..... E21B 19/10 269/208

(Continued)

*Primary Examiner* — Blake Michener
(74) *Attorney, Agent, or Firm* — Kenneth H. Jack; Davis & Jack, L.L.C.

(57) ABSTRACT

A tool for holding a well column pipe, the tool incorporating a plate having a lateral end, an oppositely lateral end, a longitudinal end, and an oppositely longitudinal end; a seam extending oppositely laterally from the plate's lateral end, the seam dividing the plate into longitudinal and oppositely longitudinal segments; a hinge connected operatively to the plate at a lateral end of the seam; a releasable latch connected operatively to the plate at an oppositely lateral end of the seam; a jaw connected operatively to a segment selected from the group consisting of the plate's longitudinal segment and the plate's oppositely longitudinal segment, the jaw being adapted for frictional engagement with the well column pipe; and a jack screw actuator for driving the well column pipe against the jaw.

18 Claims, 11 Drawing Sheets

(56) References Cited

U.S. PATENT DOCUMENTS

| | | | | |
|---|---|---|---|---|
| 6,517,042 | B1 * | 2/2003 | Mlakar | A47G 33/1213 248/172 |
| 2008/0061487 | A1 * | 3/2008 | Falk | B23K 37/0533 269/287 |
| 2015/0034335 | A1 * | 2/2015 | Brown | E21B 19/10 166/77.51 |
| 2022/0025718 | A1 * | 1/2022 | Newton | E21B 19/10 |

* cited by examiner

WELL COLUMN PIPE HOLDING TOOL

CLAIM OF BENEFIT OF PREVIOUSLY FILED PATENT APPLICATION

The instant application constitutes a continuation in part of U.S. patent application Ser. No. 17/494,572 entitled "Well Column Pipe Holding Tool", filed Oct. 5, 2021. To the extent that the disclosures of the instant application and said '572 application are the same, the benefit of the Oct. 5, 2021 filing date is claimed. The inventor and applicant of the '572 application and of the instant application are the same.

FIELD OF THE INVENTION

This invention relates to water wells having a casing which defines a vertically extending hollow bore, such bore housing a vertically extending water conveying column pipe. More particularly, this invention relates to tools which are adapted for temporarily holding such well column pipes at a partially raised position in relation to the casing's upper opening.

BACKGROUND OF THE INVENTION

Maintenance of a water well often entails periodically vertically extracting the well's column pipe from the well's bore for performance of maintenance upon the column pipe or upon a pump mounted to the pipe's lower end. To perform such maintenance, a pipe lifting apparatus is often applied to the well's column pipe for raising the column pipe out of the well's bore, such apparatus often having a lifting stroke which spans only a small fraction of the length of the column pipe. Accordingly, such lifting apparatus must be operated progressively or in successive steps upon the length of the column pipe, such operation commonly entailing repeated attachments and detachments of the lifting apparatus to and from the column pipe. While such lifting apparatus is detached from the column pipe, separate mechanical tool means are known to be provided for temporarily fixing the column pipe at an intermediate partially raised elevation, such mechanical means commonly comprising a pipe clamping mechanism. Known configurations of such pipe holding tools are often excessively mechanically complex, and are difficult, cumbersome, and awkward to utilize.

The instant inventive tool for holding a column pipe solves or ameliorates the above described disadvantages of such known column pipe holding tools by providing a specially configured well head casing bridging plate which incorporates specialized seam, hinge, latch, and pipe clamping features.

BRIEF SUMMARY OF THE INVENTION

A first structural component of the instant inventive tool for holding a column pipe comprises a metal well head bridging plate having an approximate ¾" vertical thickness, such plate having lateral, oppositely lateral, longitudinal, and oppositely longitudinal ends.

A further structural component of the instant inventive tool comprises a seam which extends oppositely laterally from the plate's lateral end, such seam dividing the plate into longitudinal and oppositely longitudinal segments. In a preferred embodiment, opposing faces of the seam form opposing semi-circular column pipe receiving concavities. Also in the preferred embodiment, the opposing faces of the seam form a plate stiffening tongue and groove joint.

A further structural component of the instant inventive tool comprises a hinge which is connected operatively to the plate, the hinge being positioned at a lateral end of the plate's seam. Where the seam forms a tongue and groove joint, the groove portion of such joint may advantageously form and function as vertically paired legs of a pivot facilitating clevis joint. Correspondingly, the tongue portion of the tongue and groove joint may advantageously function as the central tang portion of such clevis joint. Vertically aligned eyes may extend through and open at such clevis joint legs and tang, and a hinge pin may extend vertically through such vertically aligned eyes.

A further structural component of the instant inventive tool comprises a releasable latch which is suitably connected operatively to the plate at an oppositely lateral end of the plate's seam. Where the tongue and groove configuration of the seam is provided, the releasable latch component may be configured similarly with the clevis joint configuration of the hinge. In such releasable latch configuration, a pull pin may be provided in place of the pivot pin at the opposite end of the seam.

Further structural components of the instant inventive tool comprise at least a first jaw which is connected operatively to or formed wholly with a segment selected from the group consisting of the plate's longitudinal segment and the plate's oppositely longitudinal segment. In a suitable embodiment, the at least first jaw is adapted to frictionally engage a well column pipe, such adaption suitably comprising a vertical series of pipe biting teeth or "V" ridges.

Further structural components of the instant inventive tool comprise means for driving a side wall of the well column pipe against the at least first jaw. In a suitable embodiment, such means comprise a jack screw actuator which is mounted to the plate. Such actuator is preferably adapted for driving the at least first jaw against a well column pipe which extends vertically through the preferably provided semi-circular concavity sections of the plate segmenting seam.

In a suitable alternative configuration of the inventive tool, such driving means may comprise a pivot arm having proximal and distal ends wherein the proximal end is pivotally attached to one of the plate's segments, and wherein the distal end presents a vertical series of pipe biting teeth or "V" ridges. Upon frictional engagement of such pivot arm's distal end teeth with a well column pipe, the pivot arm advantageously binds against the column pipe, effectively resisting any downward sliding motion of the column pipe through the tool's plate.

In operation of the instant inventive tool for holding a well column pipe, an operator may initially manually or mechanically partially raise a water well's well column pipe a short vertical distance above the upper opening of the well's casing. While holding the column pipe at such partially raised position, the operator may release the tool's releasable latch, and may angularly splay the plate's segments, such segments pivoting about the hinge at the lateral end of the plate. Thereafter, the plate may be downwardly placed over the well's bore, such placement allowing undersurfaces of the plate's segments to bridge across the upper lip of the well's casing. Thereafter, the plate may be pivoted to its closed position, such closure allowing the plate's tongue and groove joint components to merge. Upon such closure, the seam's semi-circular concavities advantageously encircle the column pipe. Thereafter, and assuming that the means for driving the well column pipe against the at least first jaw comprises a jack screw actuator, such actuator may be operated to drive the at least first jaw in the horizontal direction toward the well column pipe. Contact between the jaw and well column pipe effectively drives the well column pipe horizontally within the pipe encircling concavities until an opposite side of the well column pipe impinges against a semi-circular seam well surface or against a second jaw surface provided at such seam. Further operation of the jack screw compressively drives the well column pipe and the first jaw against each other, such screw actuated jaw compression securely holds the well column pipe at the partially raised location.

Thereafter, the operator may reapply the lifting mechanism at a lower location upon the column pipe. Repetitions of the tool usage steps described above may effectively progressively raise the well column pipe completely out of the well's casing with no risk of downward slippage of the well column pipe into the casing's bore.

Accordingly, objects of the instant invention include the provision of a tool for holding a well column pipe which incorporates structures as described above, and which arranges those structures in relation to each other in manners described above, for the achievement of and performance of beneficial functions described above.

Other and further objects, benefits, and advantages of the instant invention will become known to those skilled in the art upon review of the Detailed Description which follows, and upon review of the appended drawings.

DETAILED DESCRIPTION OF PREFERRED EMBODIMENTS

Figure 1:
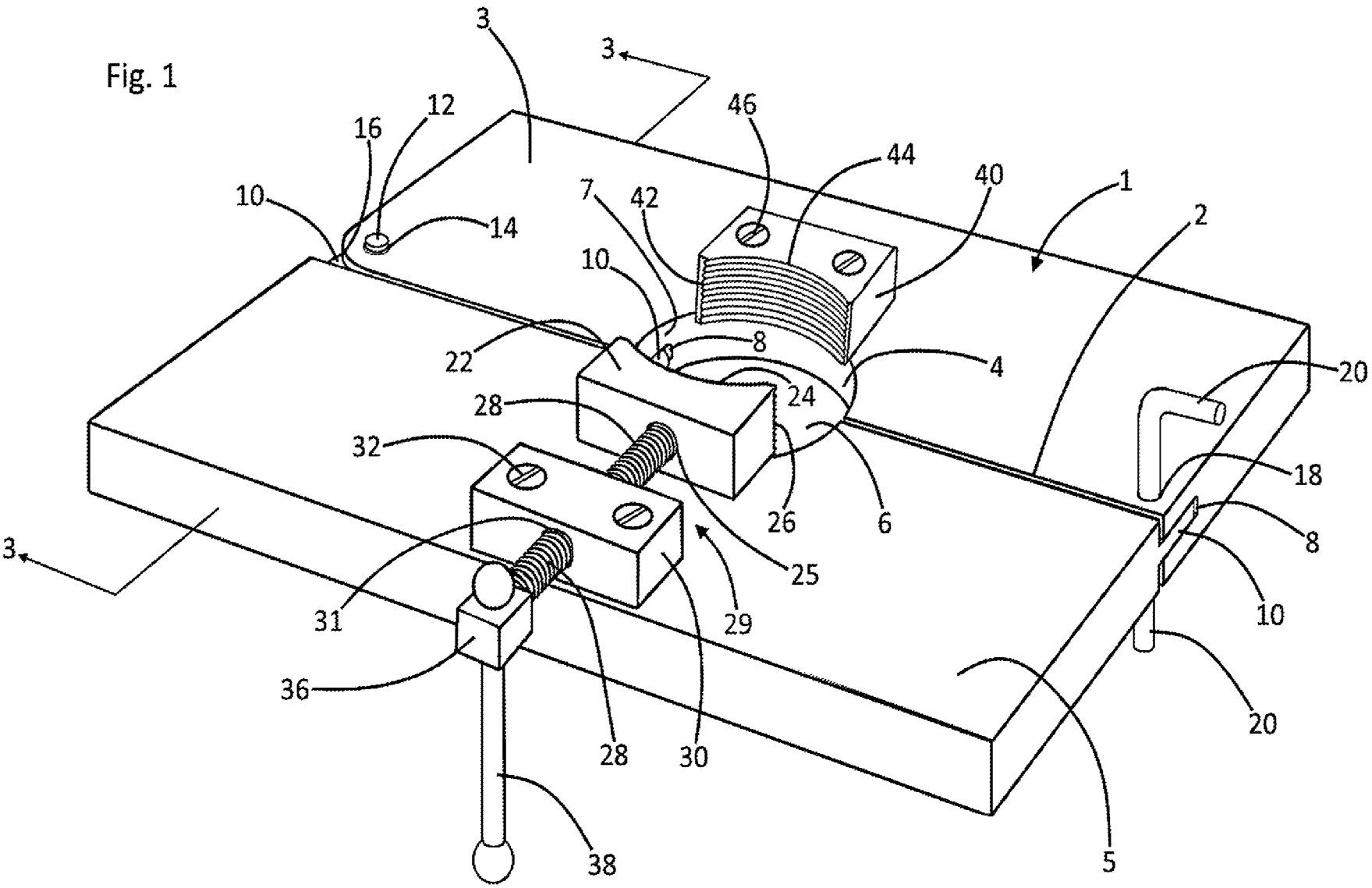
FIG. 1 is a perspective view of a suitable embodiment of the instant inventive well column pipe holding tool.
Figure 2:
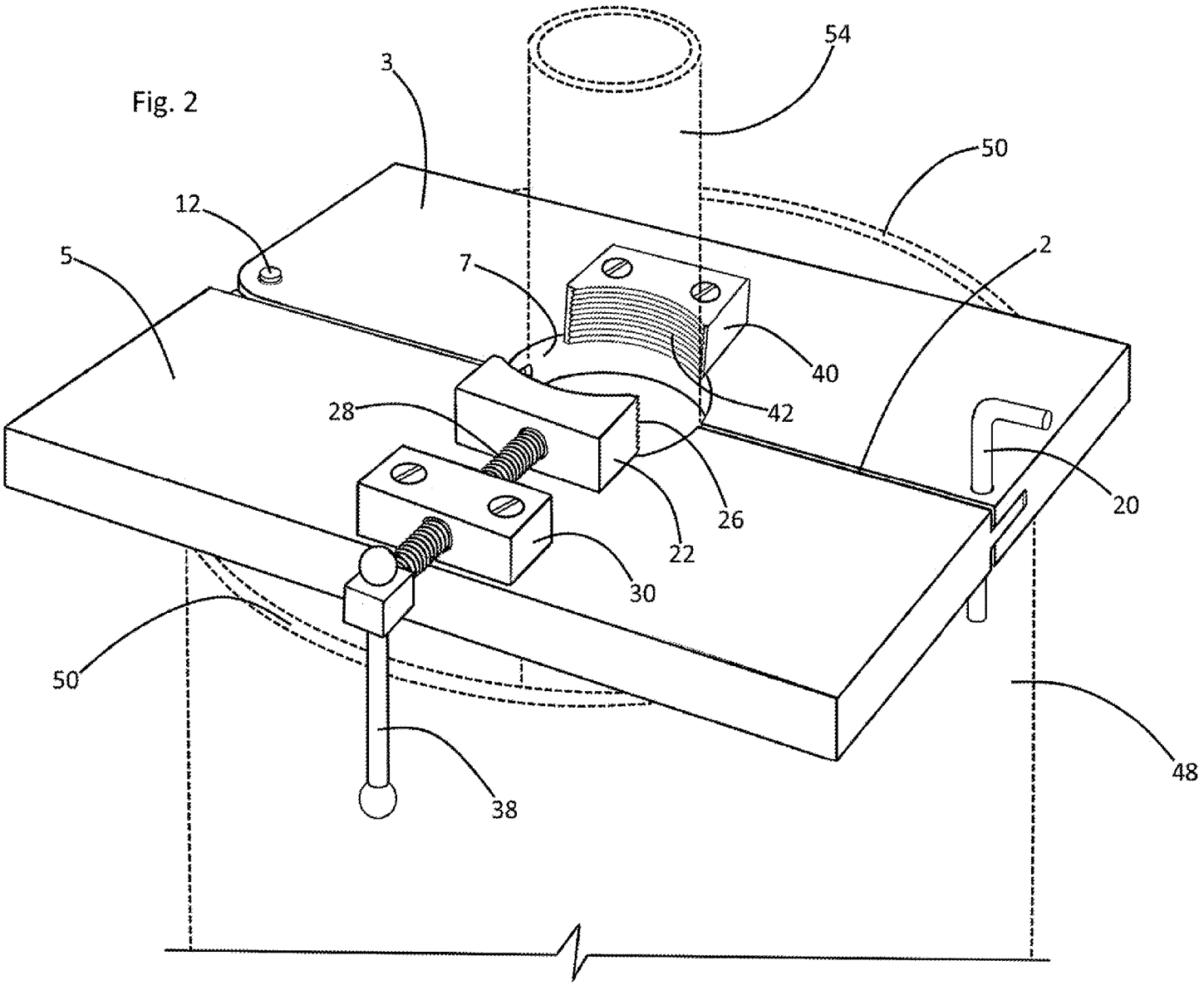
FIG. 2 redepicts the structure of FIG. 1, the view of FIG. 2 showing the tool in use upon a well casing and well column pipe.
Figure 3:
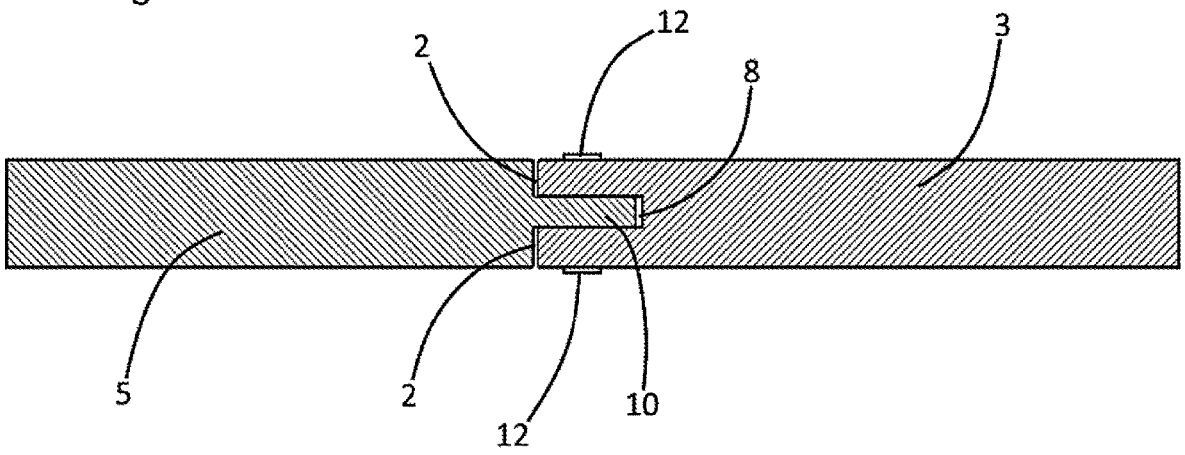
FIG. 3 is a sectional view as indicated in FIG. 1.
Figure 4:
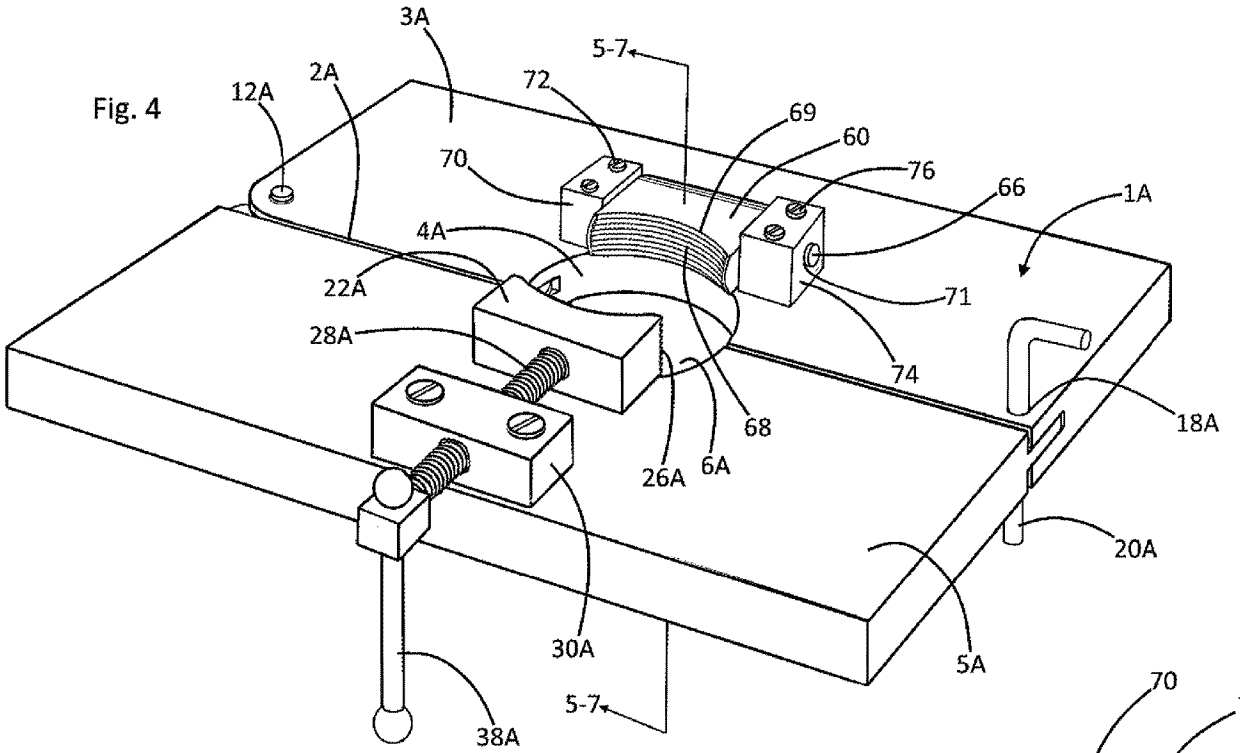
FIG. 4 presents an alternative configuration of the structure of FIG. 1.
Figure 5:
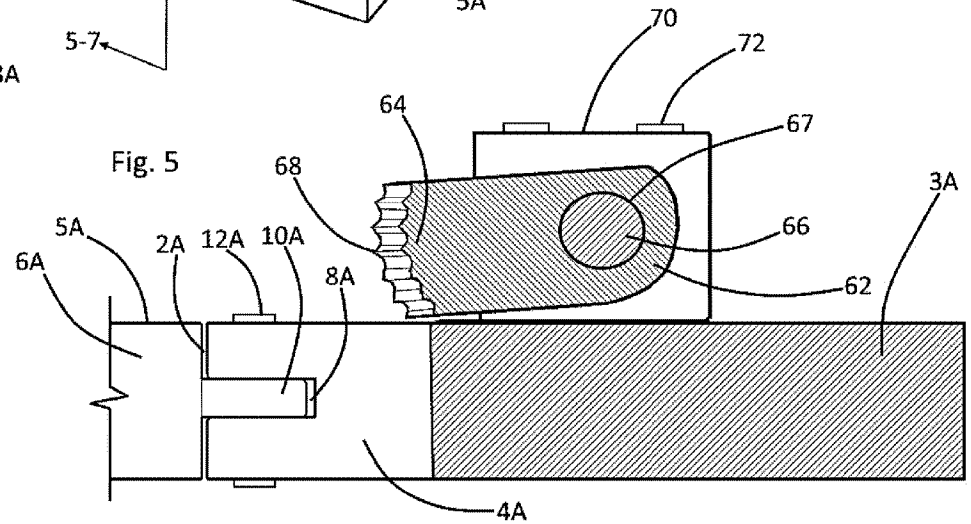
FIG. 5 is a partial sectional view of the structure of FIG. 4, as indicated in FIG. 4.

Referring now to the drawings and in particular to Drawing FIGS. 1-3, a suitable embodiment of the instant inventive well column pipe holding tool incorporates a well head bridging plate which is referred to generally by Reference Arrow 1. Such plate 1 has a lateral end which is positioned leftwardly according to the view of FIG. 1, an oppositely lateral end opposite the lateral end, a longitudinal end facing away from the viewer of FIG. 1, and an oppositely longitudinal end facing toward the viewer of FIG. 1.

The plate 1 has a seam 2 which extends oppositely laterally from the plate's lateral end, such seam 2 dividing the plate 1 into longitudinal and oppositely longitudinal segments 3 and 5. As shown in FIG. 1, each of the plate segments 3 and 5 is laterally oblongated in the direction of the seam 2, such lateral oblongation causing the longitudinal and oppositely longitudinal ends of the substantially rectangular plate 1 to be longer than such plate's lateral and oppositely lateral ends. As may be seen in FIG. 2, the laterally oblongated character of the plate segments 3 and 5 allows each of them to bridge and span across the upper opening or end 50 of a well casing pipe 48. Additional functions and benefits of the plate segments' lateral oblongation are described below.

In a suitable embodiment, the seam 2 is specially configured to form and function as a tongue and groove combination or joint. The tongue portion 10 of such joint extends longitudinally from the longitudinal end of the oppositely longitudinal plate segment 5, and the groove portion 8 of such joint opens oppositely longitudinally at the oppositely longitudinal end of the plate's longitudinal segment 3. Also, in the suitable embodiment, the longitudinal and oppositely longitudinal faces or walls of the seam 2 form opposing concave spaces 4 and 6. Referring in particular to FIG. 2, such concave spaces 4 and 6 facilitate a receipt within the tool of a column pipe 54. Upon a pivoting movement of the plate segments 3 and 5 to the closed position depicted in FIG. 2, the concavities 4 and 6 advantageously circularly surround the column pipe 54.

At least a first hinge is incorporated into the inventive tool. Where the seam 2 includes a tongue and groove combination 8,10, the hinge may advantageously utilize lateral ends of the tongue and groove as a pivoting clevis joint. The central tang portion of the clevis joint is advantageously provided by the lateral end of the tongue 10, and the paired legs of such joint are advantageously provided by the portions of the longitudinal segment 3 which directly overlie and underlie the lateral end of the groove 8. Vertically aligned eyes 14 extend through such clevis legs and through such clevis tang, and a hinge pin or pivot pin 12 extends vertically therethrough. In order to facilitate pivoting motion of the longitudinal and oppositely longitudinal plate segments 3 and 5 about the pin 12, the lateral end of the tongue 10, and the lateral ends of the clevis legs are circularly relieved to present curved edges 16. Other commonly known hinge configurations which are capable of facilitating pivoting movement of plate segments 3 and 5 between opened and closed positions are considered to fall within the scope of the invention.

A further structural component of the instant inventive tool comprises a releasable latch which is connected operatively to the plate 1, such latch suitably being positioned at the oppositely lateral end of the seam 2. Where the seam 2 incorporates the tongue and groove combination 10,8, the releasable latch may be advantageously adopt a clevis configuration similar to that of the lateral hinge. Vertically aligned eyes 18 may extend through the oppositely lateral ends of the clevis joint's paired legs and tang. Similarly with the lateral end extension of the pivot pin 12, a pull pin 20 may be extended vertically through the aligned eyes 18. Other commonly known and commonly configured releasable clasps and latches are considered to fall within the scope of the invention.

A further structural component of the instant inventive tool comprises at least a first jaw, for example jaw 22, which is connected operatively to a plate segment selected from the group consisting of the longitudinal plate segment 3, and the oppositely longitudinal plate segment 5. In the example of FIG. 1, such exemplary at least first jaw 22 is connected operatively to the oppositely longitudinal plate segment 5. Such jaw 22 has a longitudinal column pipe engaging surface or face 24, which is concave and opens in the longitudinal direction. A vertically stacked series of horizontally extending "V" ridges or teeth 26 extend longitudinally from such convex face 24, such ridges adapting the jaw 22 for high friction impingement against a column pipe.

Further structural components of the instant inventive tool comprise means for compressively driving a well column pipe, such as column pipe 54, against the at least first jaw 22. In a suitable embodiment, such means comprises a jack screw actuator assembly which is referred to generally by Reference Arrow 29. Such actuator assembly 29 suitably incorporates an externally helically threaded screw 28 mounted in threaded combination with a coupling nut 30 having a helically threaded bore 31. Such coupling nut 30 is suitably rigidly mounted to the plate's oppositely longitudinal segment 5 by mounting screws 32, and a longitudinal end of such screw 28 engages the at least first jaw 22 within a rotary bearing socket 25. The oppositely longitudinal end of the screw 28 presents a turn block 36 through which a turn handle 38 passes.

In operation of the inventive tool an operator may initially splay the plate segments 3 and 5 angularly away from each other to form an opened "V" configuration with hinge pin 12 at the vertex. Thereafter, the plate 1 may be placed at rest upon the upper lip 50 of the casing 48 of a water well. Such placement in combination with the plate segments' lateral oblongation allows each of the plate segments 3 and 5 to bridge across the hollow bore of the case 48 while the column pipe 54 resides between the plate segment legs of such "V" configuration.

Thereafter, the operator may pivot plate segments 3 and 5 toward each other, causing the seam's concavities 4 and 6 to surround and circularly capture the column pipe 54. Thereafter, the operator may extend the pull pin 20 downwardly through aligned eyes 18, effectively securing the closed plate 1 about the column pipe 54 while the plate segments continue to bridge the well head. Thereafter, the operator may manually rotate turn handle 38 clockwise causing the screw 28 to drive the at least first jaw 22 in the longitudinal direction. Such screw driving causes the "V" ridge configured teeth 26 of jaw 22 to impinge against the side wall of the column pipe 54. Further turning of handle 38 and screw 28 drives the column pipe 54 longitudinally within the circular space defined by concavities 4 and 6.

In the absence of a separately provided and attached second jaw 40, as depicted in FIG. 1, such longitudinal driving of the column pipe 54 may continue until the longitudinal side of such pipe contacts the curved wall 7 of concavity 4. In absence of the separate jaw 40, such wall surface may include knurling or "V" ridges (not depicted within views) in order to enhance frictioned contact with the column pipe 54. Following contact of the pipe 54 with wall surface 7, further turning of the handle 38 and screw 28 may compressively drive the longitudinal side of the column pipe 54 against such wall surface 7 while simultaneously compressively driving the oppositely longitudinal side of such pipe against the teeth 26 of the first jaw 22.

In a more preferred embodiment, such screw actuated pipe driving is simultaneously directed against a separately provided and attached second jaw 40, instead of against seam face 7. Similarly with the at least first jaw 22, such second jaw 40 may be mounted by screws 46, jaw 40 similarly presenting a concave pipe receiving face or surface 44. Like the first jaw's concave face 24, the second jaw's concave face 44 may advantageously present a vertical series of pipe biting "V" ridges or teeth 42. Upon screw actuated driving of the at least first jaw 22 in the longitudinal direction against the column pipe 54, the oppositely longitudinal and longitudinal series of "V" ridges 26 and 42 frictionally engage and bite against opposite sides of the column pipe 54, securely holding the column pipe.

Referring in particular to FIG. 2, column pipe 54 may weigh several hundred pounds, such weight translating as a downward force applied to the "V" ridge configured teeth 26 and 42. Such downward force may undesirably tend to downwardly buckle the plate 1 along its central seam 2. In order to resist such downward buckling, the tongue 10 of the seam's tongue and groove combination 10,8, preferably has a horizontal seam stiffening extension between ¾" and 1½". As indicated above, the plate segments 3 and 5 are preferably laterally oblongated. Such lateral oblongations, in addition to facilitating casing pipe bridging, produce a lateral elongation or an extension in the lateral direction of the tongue and groove combination which is formed at the faces of the seam. The enhanced lateral extension of the tongue and groove combination which is produced by the laterally oblongated character of the plate segments beneficially increases the overall size of the tongue which is nestingly received within the correspondingly size enhanced groove. These size enhanced features of the elongated tongue and groove components advantageously resist deformation or breakage of those components and resist buckling of the plate at the seam which may occur upon such deformation or breakage. The horizontal seam stiffening extensions of the tongue and groove combination advantageously resist buckling of the plate upon downward loading. In order to further resist such buckling of the seamed plate 1, the series of "V" ridges 26 and 42 are preferably vertically extended so that their uppermost "V" ridges are vertically displaced from their lowermost "V" ridges a distance between ½" and 2".

Referring simultaneously to FIGS. 4-7, all structures which are identified by a reference numeral having the suffix "A" are configured substantially identically with similarly numbered structures appearing in FIGS. 1-3. In the FIGS. 4-7 embodiment, the tool's at least first jaw may be alternatively recognized as a pivot arm 60 which has a proximal end 62 and a distal end 64. A hinge pin component of the tool's second hinge 66 extends laterally through a pin receiving bore 67 formed within and through the proximal end of the pivot arm 60. Such pin 66 further extends through laterally extending bores 71 formed within lateral and oppositely lateral hinge pin mounting blocks 70 and 74. Similarly with the rigid mount of internally helically threaded coupling nut 30A, the hinge pin mounting blocks 70 and 74 are rigidly mounted to the longitudinal plate segment 3A by means of mounting bolts 72 and 76. The distal end 64 of the pivot arm 60 preferably presents a plurality of arcuately curved "V" ridges or teeth 68, such "V" ridges forming a concave pipe engaging face 69.

Figure 6:
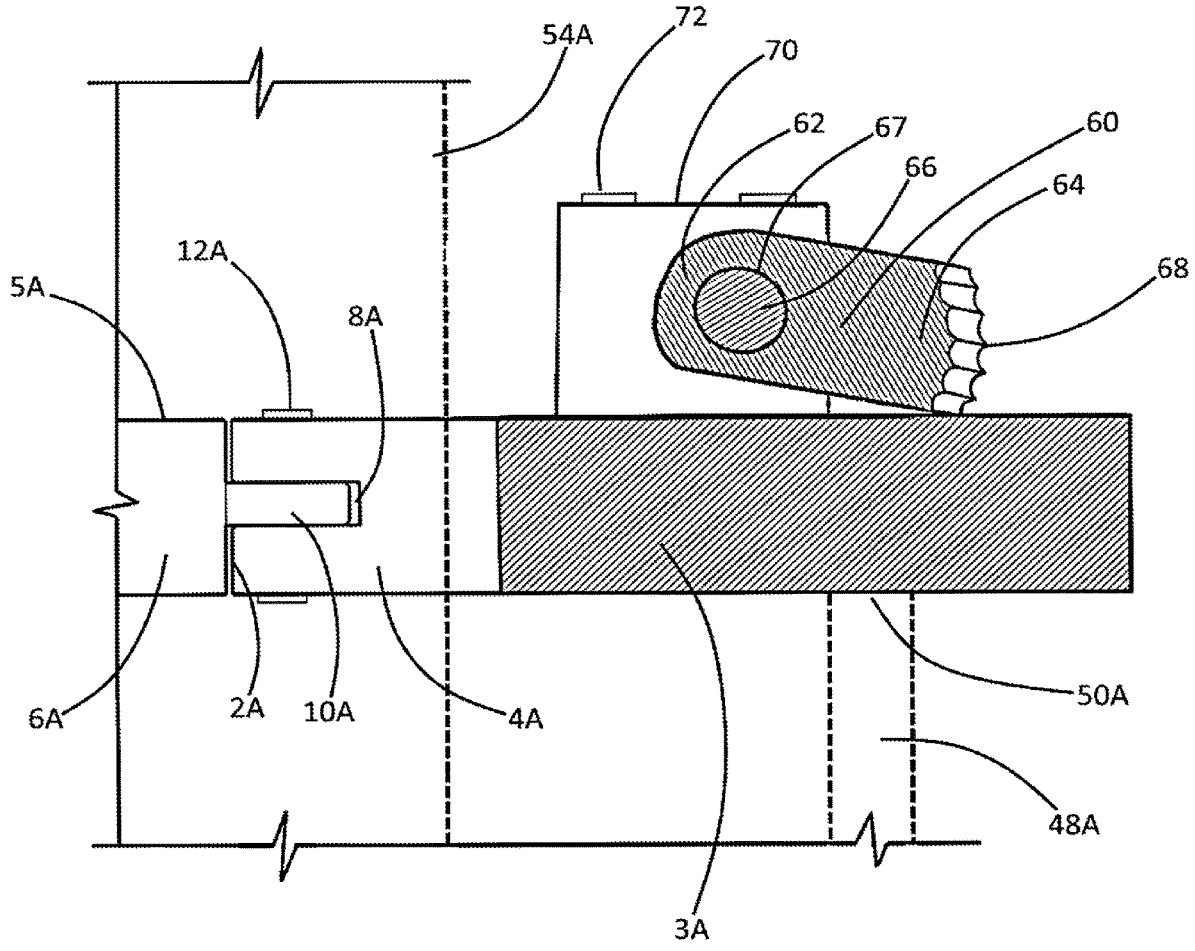
FIG. 6 presents an alternate configuration of the structures depicted in FIG. 5.
Figure 7:
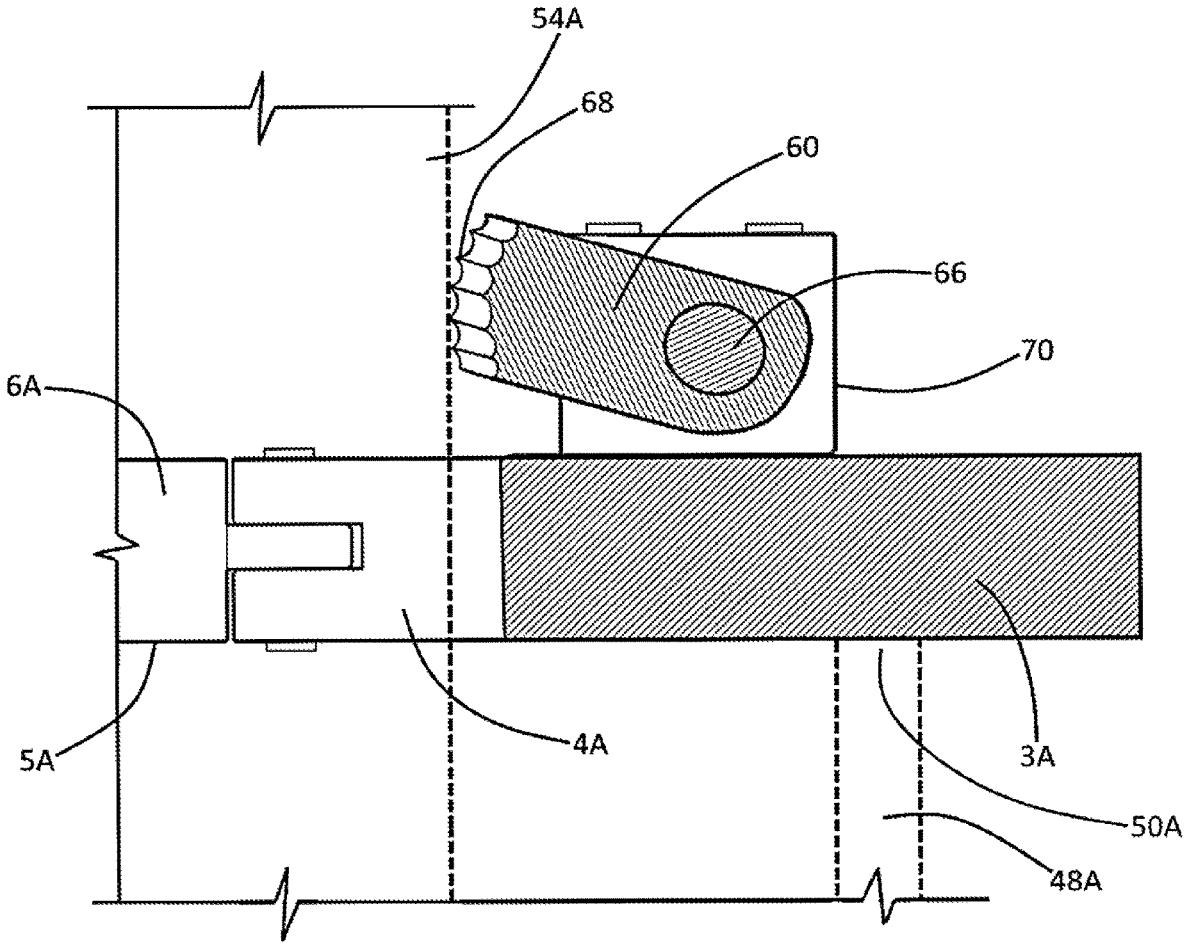
FIG. 7 presents a further alternate configuration of structures depicted in FIG. 5.

In use of the inventive tool in its FIGS. 4-7 configuration, an operator may initially splay plate segments 3A and 5A, and may initially pivot the pivot arm 60 longitudinally to assume the opened configuration depicted in FIG. 6. Thereafter, the plate 1A may be closed about column pipe 54A, then latched closed through a downward extension of pull pin 20A through aligned eyes 18A. Thereafter, the operator may manually pivot the pivot arm 60 in the oppositely longitudinal direction until such arm's distal "V" ridge teeth 68 contact the longitudinal side of column pipe 54A, as depicted in FIG. 7.

Prior to such oppositely longitudinal pivoting of the pivot arm 60, the position of the tool's second jaw 22A is preferably adjusted to closely accommodate the diameter of the column pipe 54. Screw 28A may be turned so that, upon simultaneous contacts of "V" ridge teeth series 26A and 68 with the opposite sides of the column pipe 54A, the pivot arm 60 extends at a shallow upward angle similar to the angle depicted in FIG. 7.

Upon such jaw positioning and pivot arm angular adjustment, the downwardly directed weight of the column pipe advantageously causes the pivot arm 60 and its "V" ridge teeth to bite against and compressively bind the column pipe 54A within concavities 4A and 6A. Such pivot arm actuated compression advantageously fixes and secures the column pipe 54A at the depicted vertical position in relation to the upper lip 50A of the well casing 48A. An upward pulling force applied to the column pipe in excess of the column pipe's weight freely moves the column pipe 54A upwardly, effectively temporarily releasing the pipe binding action of the pivot arm 60.

Figure 10:
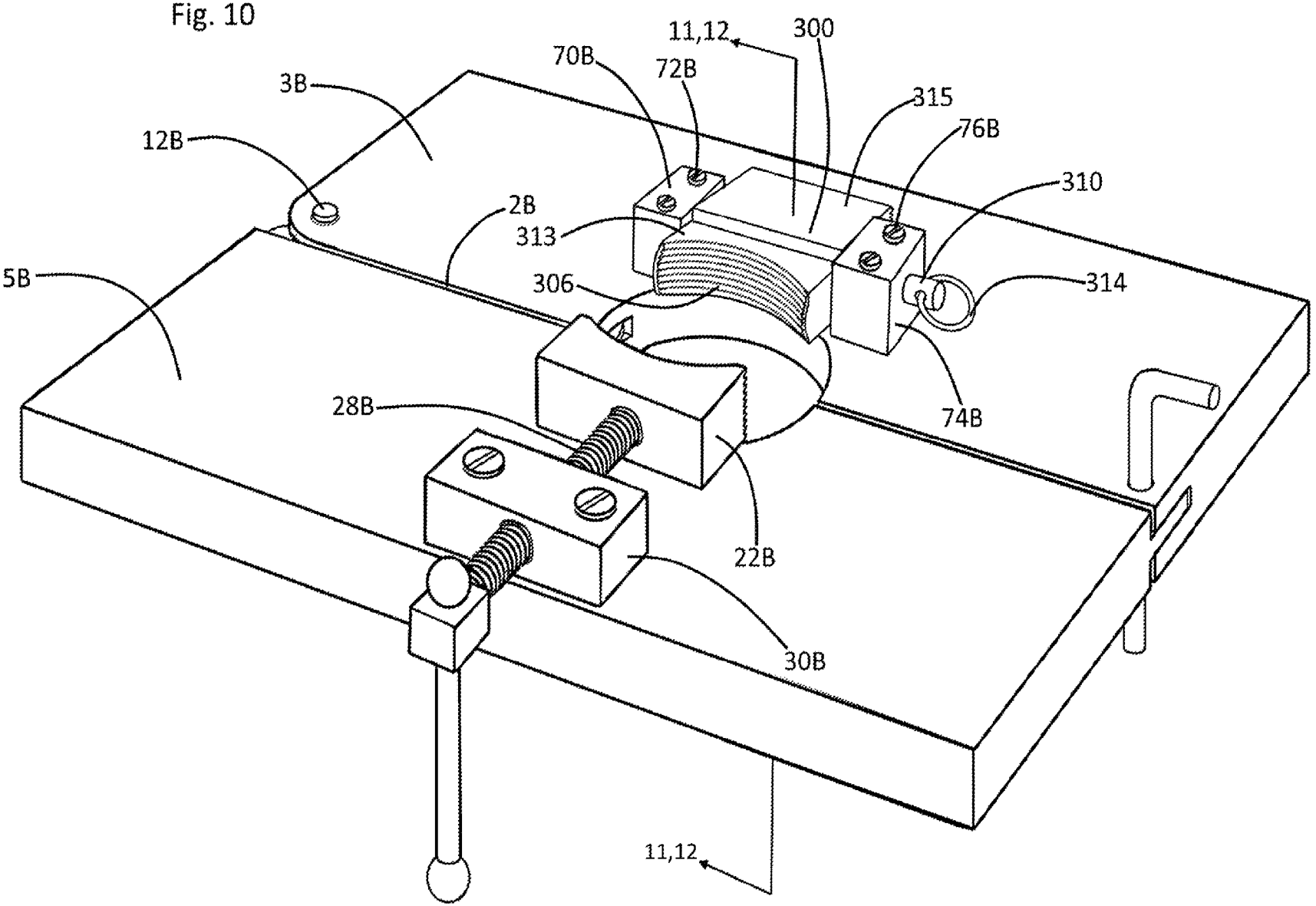
FIG. 10 presents a further alternate configuration of the tool of FIG. 1.
Figure 11:
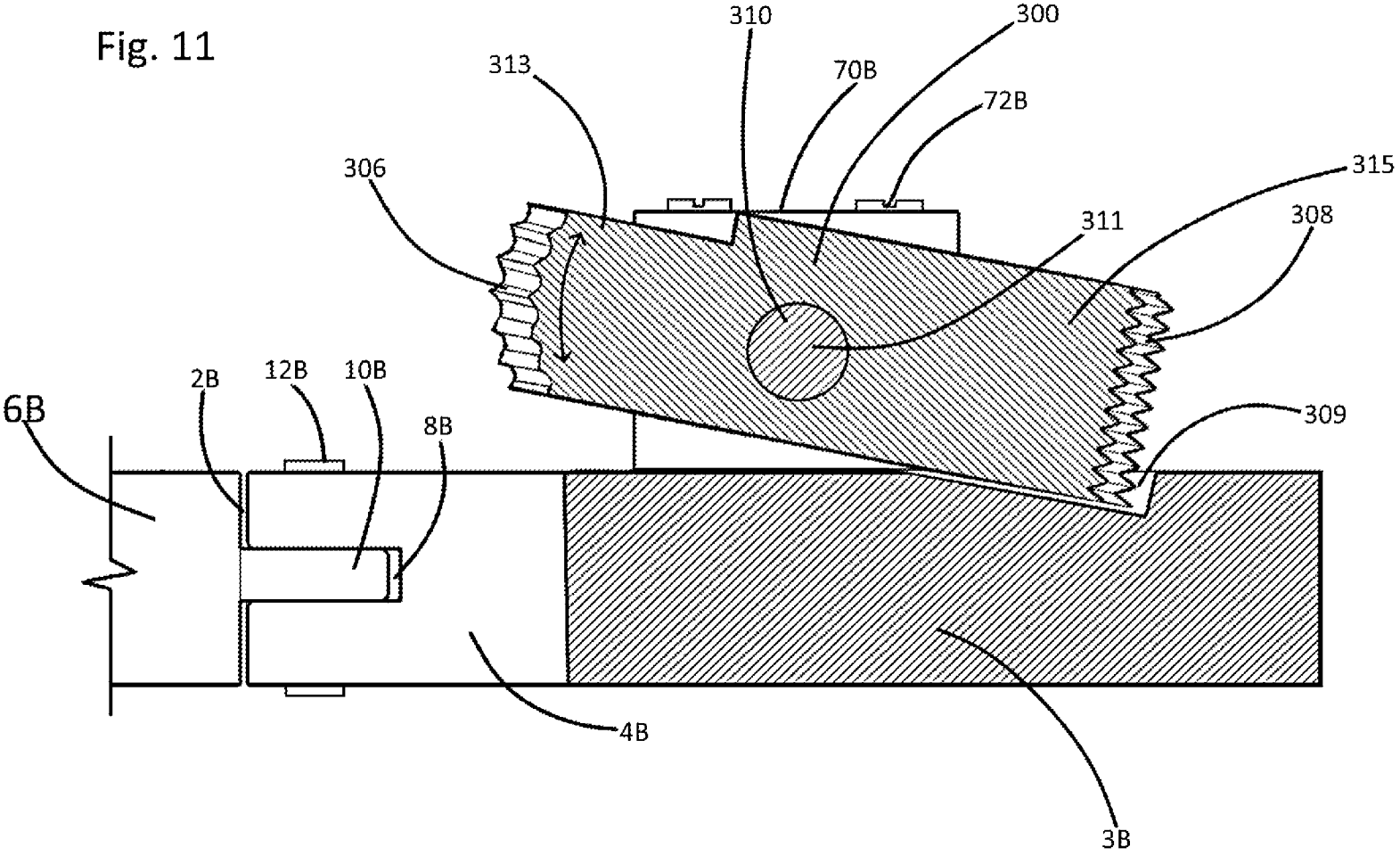
FIG. 11 is a partial sectional view as indicated in FIG. 10.
Figure 12:
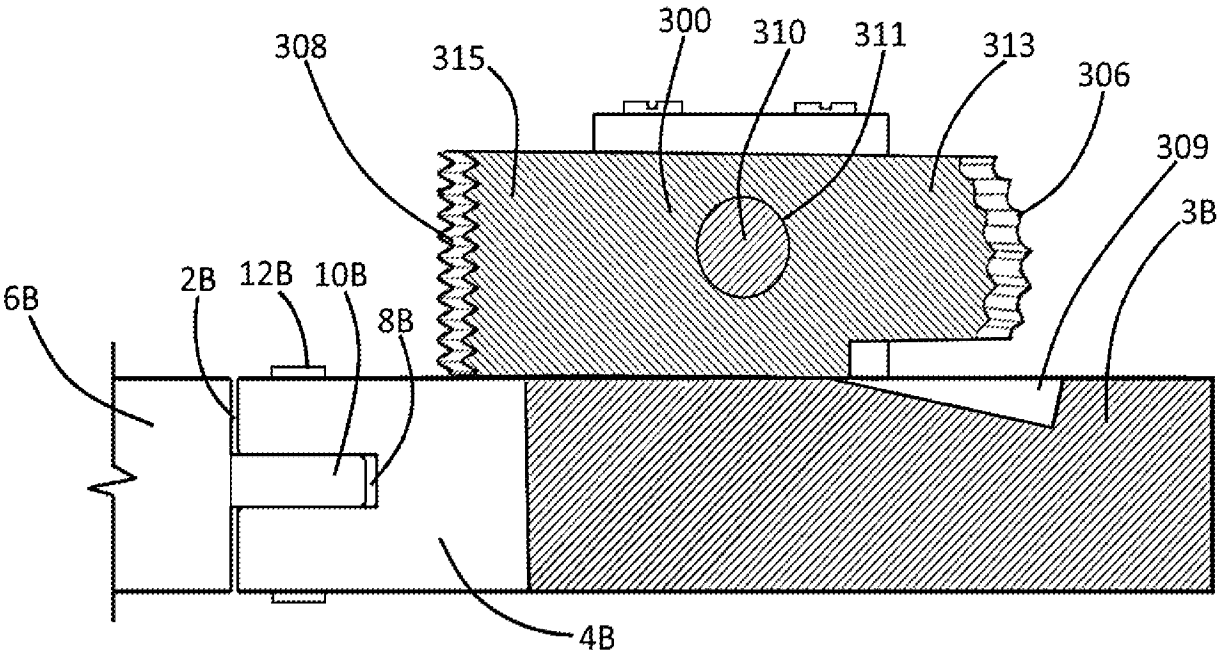
FIG. 12 presents an alternate configuration of structures depicted in FIG. 11.

In the further alternative configuration of FIGS. 10-12, all structures which are identified by a reference numeral having a suffix "B" are configured substantially identically with similarly numbered structures appearing in FIGS. 1-7. In the FIGS. 10-12 alternative structure, a clamping block 300 and axle or hinge pin 310 combination is fixedly attached to plate segment 3B, such combination being referred to generally by reference arrow 299. The fixed attachment of the clamping block and hinge pin combination 299 is suitably effected by axle mount blocks 70B and 74B, such blocks being fastened by screws 72B and 76B. to the plate by lateral and oppositely lateral axle mounting blocks 70B and 74B. The clamping block 300 has a pair of arms 313 and 315 whose distal ends present pipe biting teeth 306 and 308, and whose proximal ends reside at a laterally extending axle bore 311.

While the clamping clock 300 is mounted in the FIG. 11 configuration, arm 313 freely pivots upwardly and downwardly about axle 310. A recess 309 within the upper surface of plate segment 3B may be provided in order to facilitate additional degrees of angular movement of arm 313 and its distal end teeth 306. In the FIG. 11 configuration, the clamping block 300 functions substantially identically with clamping arm 60 of the tool's FIG. 7 configuration described above. In operation of the tool of FIG. 11, the distance between the jack screw actuated jaw 22B and teeth 306 may substantially match the outside diameter of a well column pipe. Such structural arrangement advantageously allows the pipe to be progressively pulled upwardly with downward travel restricted by the pipe biting action of arm 313 and its distal teeth 306.

An operator of the tool of FIG. 10 may alternatively grasp pull ring 314, and may pull the axle 310 laterally out of the axle bore 311 and out of the axle mounts 70B and 74B. Thereafter, the operator may invert the clamping block 300 while simultaneously rotating the clamping block 180 deg. about the vertical axis. Such reorientation of the clamping block 300 causes it to assume the alternative orientation and configuration of FIG. 12. Upon re-insertion of the axle 310 through bore 311 as indicated in FIG. 12, the axle securely holds the formerly upper surface of the clamping block 300 in flush and abutting contact with the upper surface of plate segment 3B. Such alternative FIG. 12 configuration fixes the opposite teeth 308 at the distal end of arm 315 against movement respect to the plate segment 3B. Accordingly, in the alternative FIG. 12 configuration, the tool of FIGS. 10-12 may operate substantially identically with the tool of FIG. 1 described above.

While the jack screw driven jaw 22 of the tool of FIGS. 1-3, and the pivot arm jaw 60 of FIGS. 4-7, and the reconfigurable clamping block of FIGS. 10-12 constitute suitable alternative means for compressively engaging and holding a well column pipe, other mechanical means for achieving such jaw actuated compression are considered to fall within the scope of the invention. For example, in the alternative configuration of FIG. 8, a well head bridging plate 100 may be segmented by a "V" configured seam 101 into longitudinal and oppositely longitudinal segments 102 and 104. A jack screw assembly 113 may be mechanically associated with the oppositely lateral ends of such segments. In such jack screw assembly 113, an oppositely lateral extension 117 of plate segment 104 has a longitudinally extending helically threaded bore 115. A second oppositely lateral extension 121 from plate segment 102 has a laterally oblongated eye 119 and presents an arcuately curved longitudinal face 123. A screw shaft 112 has a "T" head 122 at its longitudinal end and a turn block 125 at its oppositely longitudinal end. Turn handle 114 extends through the turn block 125, the helically threaded oppositely longitudinal end of the screw 112 extends through and engages the threaded bore 115, and the longitudinal end of shaft 112 extends through eye 119. The "T" head 112 captures the longitudinal end of the screw shaft 112 at the second extension 121.

Figure 8:
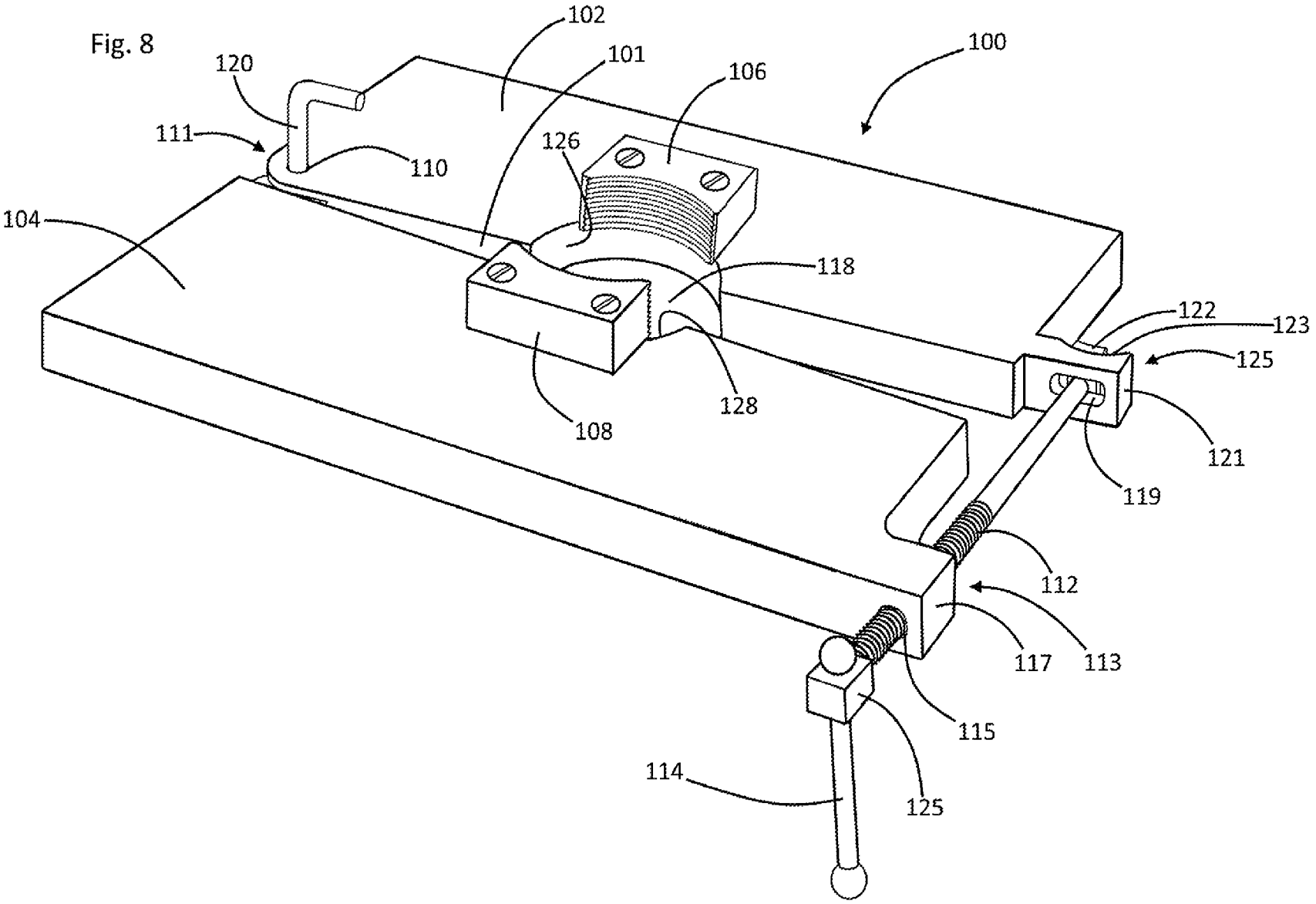
FIG. 8 presents a further alternate configuration of the tool of FIG. 1.

In the FIG. 8 configuration counter-clockwise turning of turn handle 114 rotates screw 112 to draw plate segment 102 toward plate segment 104. Jaws 106 and 108 which are fixedly attached to such plate segments simultaneously draw together to clamp a column pipe situated within central clamping space 118. Alternatively, the curved seam faces 126 and 128 may be knurled or ridged for service themselves as a the tool's opposing jaw faces.

In the FIG. 8 configuration, the pull pin 120 and the aligned eyes receiving such pin constitute a dually functioning component 111 which serves both as the tool's releasable latch and as a hinge during pipe holding operation of the tool. The connector assembly 125 at the oppositely lateral end of the tool also performs dual functions, such assembly serving as a plate drawing anchor for the jack screw assembly 113 and as a hinge for splaying of plates 102 and 104 upon release of latch 111.

Figure 9:
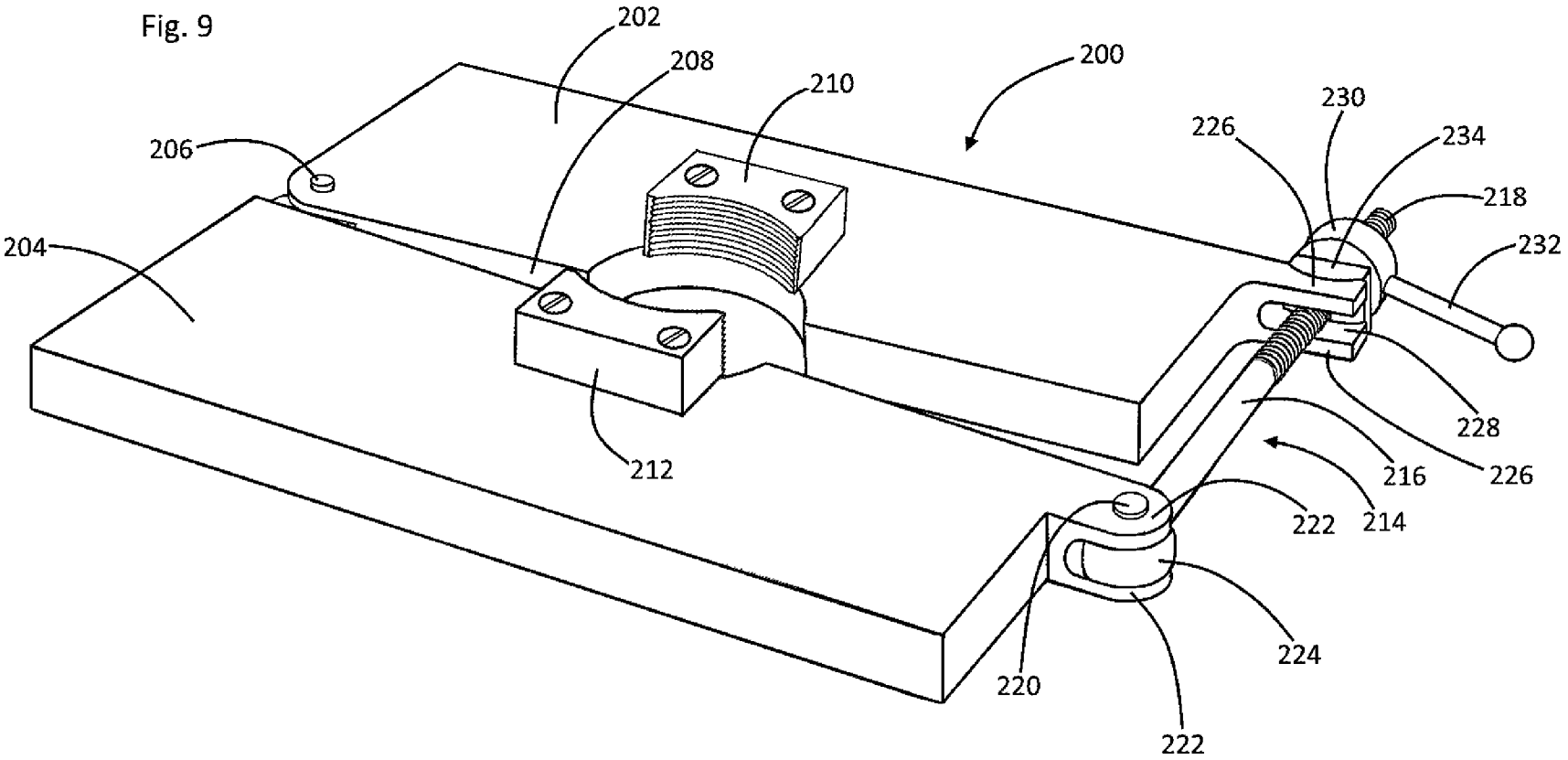
FIG. 9 presents a further alternate configuration of the tool of FIG. 1.

The plate 200 of the FIG. 9 structure constitutes a further alternative configuration of the instant invention. An angularly splayed seam 208 divides plate 200 into longitudinal and oppositely longitudinal plate segments 202 and 204, and a fixed hinge 206 interconnects those two segments at the lateral end of the seam. Fixed jaws 210 and 212 are mounted at opposing faces of the seam, the ridges of such jaws overlying the seam's central circular opening.

The FIG. 9 tool's jack screw actuator and releasable latch are positioned at the oppositely lateral ends of the seam 208 and plate segments 202 and 205, such two components being combined as a single screw drawing release latch assembly 214. Such assembly 214 has a pivoting screw shaft 216, such shaft having helical threads 218 at its distal end, and such shaft having a proximal end configured as a rotary element 224. Such element 224 serves as a tang element of a pin, aligned eyes, and clevis joint. Such joint's clevis ears 222 are fixedly attached to and extend oppositely laterally from the oppositely lateral end of the oppositely longitudinal plate segment 204, and a pivot pin or hinge pin 220 extends vertically through aligned eyes formed within such clevis ears and rotary element 224.

A nut hooking fork component 226 of the FIG. 9 tool configuration variant extends oppositely laterally from the oppositely lateral end of the longitudinal plate segment 202, such fork defining a "U" space which is fitted for receiving the screw shaft 216. The threaded distal end of the screw shaft 216 helically threadedly engages a threaded nut 230, such nut having a fixedly attached turn lever 232. An apertured swivel plate 234 receives the screw shaft 216, and upon pivoting of such shaft into space 228 between the fork's tines 226, such plate may longitudinally overlie concave longitudinal faces 227 of such tines. Counter-clockwise turning of the turn lever 232 (from the perspective of the view of FIG. 9) drives the oppositely longitudinal face of the threaded nut 230 against the longitudinal face of the swivel plate 234, such driving action simultaneously causing the convexly curved oppositely longitudinal face of the swivel plate 227 to be captured in the manner of a hooking connection within the fork's concavity 227. Further turning of lever 232 may forcefully pull the fork 226 and the longitudinal plate segment 202 toward the oppositely longitudinal plate segment 204. Such pulling action causes such plate segments to pivot about hinge 206 and to draw jaws 210 and 212 together.

Angular changes between the screw shaft 216 and the oppositely lateral ends of the plate segments 202 and 204 are accommodated by sliding motions of the swivel plate over fork faces 227.

Accordingly, the FIG. 9 tool alternative may forcefully clamp a well's column pipe situated between jaws 210 and 212. Counter-turning of lever 232 allows the fork 226 to release the screw shaft, effectively unlatching the plate segments to allow the column pipe to be released from the tool.

Other commonly known mechanical means for drawing or driving together jaw bearing plate segments such as plate segments 3 and 5, plate segments 3A and 5A, plate segments 102 and 104, and plate segments 202 and 204 are considered to fall within the scope of the invention.

While the principles of the invention have been made clear in the above illustrative embodiment, those skilled in the art ay make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A tool for holding a well column pipe at the upper end of a casing pipe, said tool comprising:

(a) a plate having a lateral end, an oppositely lateral end, a longitudinal end, and an oppositely longitudinal end, the plate being laterally oblongated;

(b) a seam having longitudinal and oppositely longitudinal faces, the seam extending oppositely laterally from the plate's lateral end, said seam dividing the plate into longitudinal and oppositely longitudinal segments, each of said longitudinal and oppositely longitudinal segments being laterally oblongated for, upon placements of said segments over the upper end of the casing pipe, bridging across said upper end;

(c) longitudinal and oppositely longitudinal concavities respectively formed by the seam's longitudinal and oppositely longitudinal faces;

(d) a hinge connected operatively to the plate, the hinge being positioned at a lateral end of the seam;

(e) a releasable latch connected operatively to the plate, the releasable latch being positioned at an oppositely lateral end of the seam;

(f) at least a first jaw fixedly attached to or formed wholly with a segment selected from the group consisting of the plate's longitudinal segment and the plate's oppositely longitudinal segment, said jaw being adapted for frictional engagement with the well column pipe; and (g) means for driving the well column pipe against the at least first jaw, wherein one of the faces among the seam's longitudinal and oppositely longitudinal faces forms a groove component of a tongue and groove combination, wherein the other face among the seam's longitudinal and oppositely longitudinal faces forms a tongue component of said tongue and groove combination, and wherein said tongue and groove combination is positioned between the hinge and the releasable latch, wherein the means for driving the well column pipe against the at least first jaw comprises a second hinge comprising an axle connected operatively to the at least first jaw, and wherein the at least first jaw comprises a clamping block, wherein said clamping block comprises a pair of arms extending oppositely from the axle, wherein each arm among the pair of arms has a distal end, wherein each arm's distal end presents a plurality of teeth.

2. The tool of claim 1 further comprising a second jaw fixedly attached to or formed wholly with the plate's other segment.

3. The tool of claim 2 further comprising a plurality of column pipe biting teeth, said teeth extending from the second jaw.

4. The tool of claim 3 wherein each tooth among the plurality of column biting teeth comprises a "V" ridge.

5. The tool of claim 4 wherein the plurality of column biting teeth comprises an uppermost tooth and a lowermost tooth, and wherein the uppermost tooth is upwardly displaced from the lowermost tooth a distance between ½ inch and 2 inches.

6. The tool of claim 1 wherein the means for driving the well column pipe against the at least first jaw further comprises a screw and coupling nut combination.

7. The tool of claim 6 further comprising turning means connected operatively to an end of the screw and coupling nut combination's screw.

8. The tool of claim 1 wherein the tongue component of the tongue and groove combination has an extension between ¾ inch and 1½ inches.

9. The tool of claim 8 wherein the hinge comprises a first clevis joint, wherein said joint comprises a tang, and wherein the tang comprises a lateral end of the tongue and groove combination's tongue.

10. The tool of claim 9 wherein a lateral end of the tang is circularly relieved.

11. The tool of claim 10 wherein the releasable latch comprises a second clevis joint.

12. The tool of claim 11 wherein the second clevis joint comprises a pull pin and alignable eyes combination, and wherein said combination's alignable eyes extend through an oppositely lateral end of the tongue and groove combination.

13. The tool of claim 1 further comprising a second jaw fixedly attached to or formed wholly with the plate, the second jaw being positioned oppositely from the at least first jaw.

14. The tool of claim 13 wherein the second jaw is fixedly attached to the plate, and wherein said fixed attachment comprises a jack screw actuator adapted for alternatively moving the second jaw toward and away from the at least first jaw.

15. A tool for holding a well column pipe at the upper end of a casing pipe, said tool comprising:

(a) a plate having an upper surface, a lateral end, an oppositely lateral end, a longitudinal end, and an oppositely longitudinal end;

(b) a seam dividing the plate into longitudinal and oppositely longitudinal segments;

(c) longitudinal and oppositely longitudinal concavities respectively formed within the longitudinal and oppositely longitudinal segments;

(d) a hinge connected operatively to the plate, the hinge being positioned at a lateral end of the seam;

(e) a releasable latch connected operatively to the plate, said latch being positioned at an oppositely lateral end of the seam;

(f) a clamping block and axle combination attached to the plate's longitudinal segment, wherein said combination's clamping block comprises a pair of arms extending oppositely from the axle, wherein each arm among the pair of arms has a distal end, wherein each arm's distal end presents a plurality of teeth, wherein, upon a further extension of one of the arms toward the longitudinal concavity, the plate's upper surface resists pivoting movements of said one of the arms, and wherein, upon an alternative further extension of the other arm toward the longitudinal concavity, the arm may pivot about the axle; and (g) means for driving the well column pipe toward the clamping block, said means being connected operatively to the plate.

16. The tool of claim 15 wherein the means for driving the well column pipe toward the clamping block comprise a jaw and jack screw actuator combination, said combination being attached to the plate's oppositely longitudinal segment.

17. The tool of claim 16 comprising a bore extending laterally through the clamping block, the bore receiving the axle, and comprising lateral and oppositely lateral mounts respectively supporting lateral and oppositely lateral ends of the axle.

18. The tool of claim 17 wherein, upon a withdrawal of the axle from the bore, upon an inversion of the of the clamping clock, and upon a re-extension the axle through the bore, pivoting of the clamping block may be selectively resisted or permitted.

* * * * *